US010985486B2

(12) United States Patent
Kitaoka

(10) Patent No.: US 10,985,486 B2
(45) Date of Patent: Apr. 20, 2021

(54) FEMALE TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Kenichi Kitaoka, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/604,679

(22) PCT Filed: Apr. 9, 2018

(86) PCT No.: PCT/JP2018/014865
§ 371 (c)(1),
(2) Date: Oct. 11, 2019

(87) PCT Pub. No.: WO2018/190286
PCT Pub. Date: Oct. 18, 2018

(65) Prior Publication Data

US 2020/0161786 A1 May 21, 2020

(30) Foreign Application Priority Data

Apr. 13, 2017 (JP) ..... JP2017-079809

(51) Int. Cl.
*H01R 13/11* (2006.01)
*H01R 13/193* (2006.01)
*H01R 13/187* (2006.01)

(52) U.S. Cl.
CPC ..... *H01R 13/113* (2013.01); *H01R 13/193* (2013.01); *H01R 13/187* (2013.01)

(58) Field of Classification Search
CPC ..... H01R 13/111–115; H01R 13/15; H01R 13/187; H01R 13/193; H01R 12/721; H01R 12/89
See application file for complete search history.

(56) References Cited

U.S. PATENT DOCUMENTS 1,536,688 A * 5/1925 Osborn ..... D06F 75/28 439/263
3,475,717 A * 10/1969 Lane ..... H01R 12/89 439/260

(Continued)

FOREIGN PATENT DOCUMENTS

JP 4-61882 5/1992
JP 2000-164271 6/2000

(Continued)

OTHER PUBLICATIONS

International Search Report dated Jun. 19, 2018.

*Primary Examiner* — Renee S Luebke
*Assistant Examiner* — Milagros Jeancharles
(74) *Attorney, Agent, or Firm* — Gerald E. Hespos; Michael J. Porco; Matthew T. Hespos

(57) ABSTRACT

A female terminal 10 to be fit to a male terminal 50 is provided with a box-shaped female body portion 12 including a ceiling wall 14 and a bottom wall 21 facing each other in a vertical direction and open in a front-rear direction, the male terminal 50 being inserted into the female body portion 12, contact pressure applying portions 16 provided between the ceiling wall 14 and the bottom wall 21 of the female body portion 12 and configured to apply a contact pressure to the male terminal 50 by contacting the male terminal 50 from the side of the ceiling wall 14, and a pressure increasing plate 30 configured to displace the contact pressure applying portions 16 toward the bottom wall 21 by being (Continued)

inserted into between the ceiling wall 14 of the female body portion 12 0 and the contact pressure applying portions 16.

3 Claims, 16 Drawing Sheets

(56) References Cited

U.S. PATENT DOCUMENTS 3,643,202 A * 2/1972 Coon ..... H01R 13/193 439/263
4,357,066 A * 11/1982 Cairns ..... H01R 12/721 439/595
4,684,194 A * 8/1987 Jenkins ..... H01R 12/89 439/260
5,897,405 A * 4/1999 Endo ..... H01R 13/11 439/852
6,129,571 A 10/2000 Ikemoto
6,244,885 B1 * 6/2001 Iwahori ..... H01R 13/113 439/263
6,379,199 B1 * 4/2002 Chen ..... H01R 13/11 439/451
9,160,082 B2 * 10/2015 Heringhaus ..... H01R 13/187
10,367,289 B2 7/2019 Sakaguchi
2001/0036775 A1 * 11/2001 Saitoh ..... H01R 13/11 439/852
2006/0172618 A1 * 8/2006 Yamashita ..... H01R 13/11 439/852
2015/0171546 A1 * 6/2015 Kibushi ..... H01R 13/114 439/382
2018/0287283 A1 * 10/2018 Sakaguchi ..... H01R 13/11

FOREIGN PATENT DOCUMENTS

JP 2000-357552 12/2000
JP 2006-216433 8/2006
JP 2011-119105 6/2011
JP 2011-129271 6/2011
JP 2014-53205 3/2014
JP 2015-5430 1/2015
JP 2017-62913 3/2017

* cited by examiner

FEMALE TERMINAL

BACKGROUND

Field of the Invention

This specification relates to a female terminal.

Related Art

Japanese Unexamined Patent Publication No. 2014-53205 discloses a female terminal is formed by press-working and bending a plate. Further, plating is applied to the processed female terminal. The female terminal includes a box in the form of a rectangular tube into which a male tab terminal is inserted, and a conductor crimping portion provided behind the box and to be crimped to a conductor of a wire. A leaf spring and a tab receiving portion are provided inside the box. The leaf spring is provided on an upper wall inside the box and resiliently contacts the male tab terminal. The tab receiving portion is provided on a lower wall inside the box and contacts the male tab terminal.

The male tab terminal is formed by press-working and bending a plate. Further, plating is applied to the processed male tab terminal. The male tab terminal includes a bar-shaped male body.

The male body that is inserted into the box of the female terminal is sandwiched between the leaf spring and the tab receiving portion. In this way, the male tab terminal and the female terminal resiliently contact and are connected electrically.

When the male tab terminal is inserted into the box of the female terminal, the male body of the male tab terminal is inserted while being resiliently pressed by the leaf spring inside the box. Thus, the plating applied to the male tab terminal and the female terminal is worn at a contact portion between the male tab terminal and the female terminal. Particularly, if the male tab terminal needs to be inserted and withdrawn many times, the wear of the plating increases. To prevent such wear of the plating, it is generally necessary to lower a contact pressure of the leaf spring of the female terminal or to increase a plating thickness. However, if the contact pressure of the leaf spring of the female terminal is lowered, the connection reliability of the terminals is reduced. Thus, there has been a problem that a connection failure of the terminals easily occurs due to vibration or the like. Further, if the plating thickness is increased without lowering the contact pressure of the leaf spring, there has been a problem that plating cost increases. As just described, it has been difficult to suppress an increase of the plating cost while ensuring the connection reliability of the terminals.

SUMMARY

A female terminal disclosed in this specification is to be fit to a male terminal and includes a box-shaped female body. The female body portion has a ceiling wall and a bottom wall facing each other in a vertical direction and open in a front-rear direction. The male terminal is inserted into the female body portion. A contact pressure applying portion is provided between the ceiling wall and the bottom wall of the female body portion and is configured to apply a contact pressure to the male terminal by contacting the male terminal from the ceiling wall side. A pressure increasing plate is configured to displace the contact pressure applying portion toward the bottom wall by being inserted between the ceiling wall of the female body portion and the contact pressure applying portion.

The contact pressure applying portion is not displaced toward the bottom wall before the insertion of the pressure increasing plate. Thus, the male terminal is inserted into the female body portion in a state where a contact pressure applied to the male terminal by the contact pressure applying portion is low or zero. Therefore, during the insertion of the male terminal into the female body, the male terminal does not slide against the contact pressure applying portion to wear plating applied to the male terminal and the female terminal. Further, terminal insertion work efficiency can be improved by reducing an insertion force during the insertion of the male terminal into the female body portion.

The contact pressure applying portion can be displaced toward the bottom wall to increase the contact pressure applied to the male terminal by inserting the pressure increasing plate into the female body portion after the insertion of the male terminal into the female body portion. Thus, the occurrence of a connection failure between the male terminal and the female terminal due to vibration or the like can be prevented.

The state where the contact pressure applied to the male terminal is low or zero is set prior to separating the male terminal from the female body portion by pulling out the pressure increasing plate from between the ceiling wall of the female body portion and the contact pressure applying portion. Thus, the male terminal will not slide against the contact pressure applying portion when separating the male terminal, and the plating applied to the male terminal and the female terminal will not wear.

The contact pressure applying portion may be a cantilever extending forward from a rear end part of the ceiling wall of the female body portion, and the pressure increasing plate may be inserted into the female body portion from the front. Thus, the pressure increasing plate can be inserted, following an operation of connecting a male housing that holds the male terminal to a female housing that holds the female terminal. Further, since the female body portion and the contact pressure applying portion are integrated, the cost of the female terminal can be reduced.

The contact pressure applying portion may include a contact portion configured to contact the male terminal, a base end part connected to the ceiling wall and a rear inclined portion connecting the contact portion and the base end part. An end part of the pressure increasing plate may slide against the rear inclined portion to displace the contact pressure applying portion toward the bottom wall. The end part of the pressure increasing plate comes into contact with the rear inclined portion of the contact pressure applying portion to push down the contact pressure applying portion toward the bottom wall during the insertion of the pressure increasing plate into the female body portion. Thus, the contact portion can be displaced toward the bottom wall to increase the contact pressure applied to the male terminal.

A bottom surface of the pressure increasing plate may be tapered rearward. Additionally, the contact pressure applying portion may include a contact portion configured to contact the male terminal and a front inclined portion inclined up toward front from the contact portion. The bottom surface of the pressure increasing plate may slide against a tip part of the front inclined portion of the contact pressure applying portion, thereby displacing the contact pressure applying portion toward the bottom wall. Thus, the contact portion can be displaced toward the bottom wall to increase the contact pressure applied to the male terminal.

According to the female terminal disclosed in this specification, an increase of plating cost can be suppressed while the connection reliability of the terminals is ensured.

DETAILED DESCRIPTION

First Embodiment

A first embodiment is described with reference to FIGS. 1 to 8.

Figure 3:
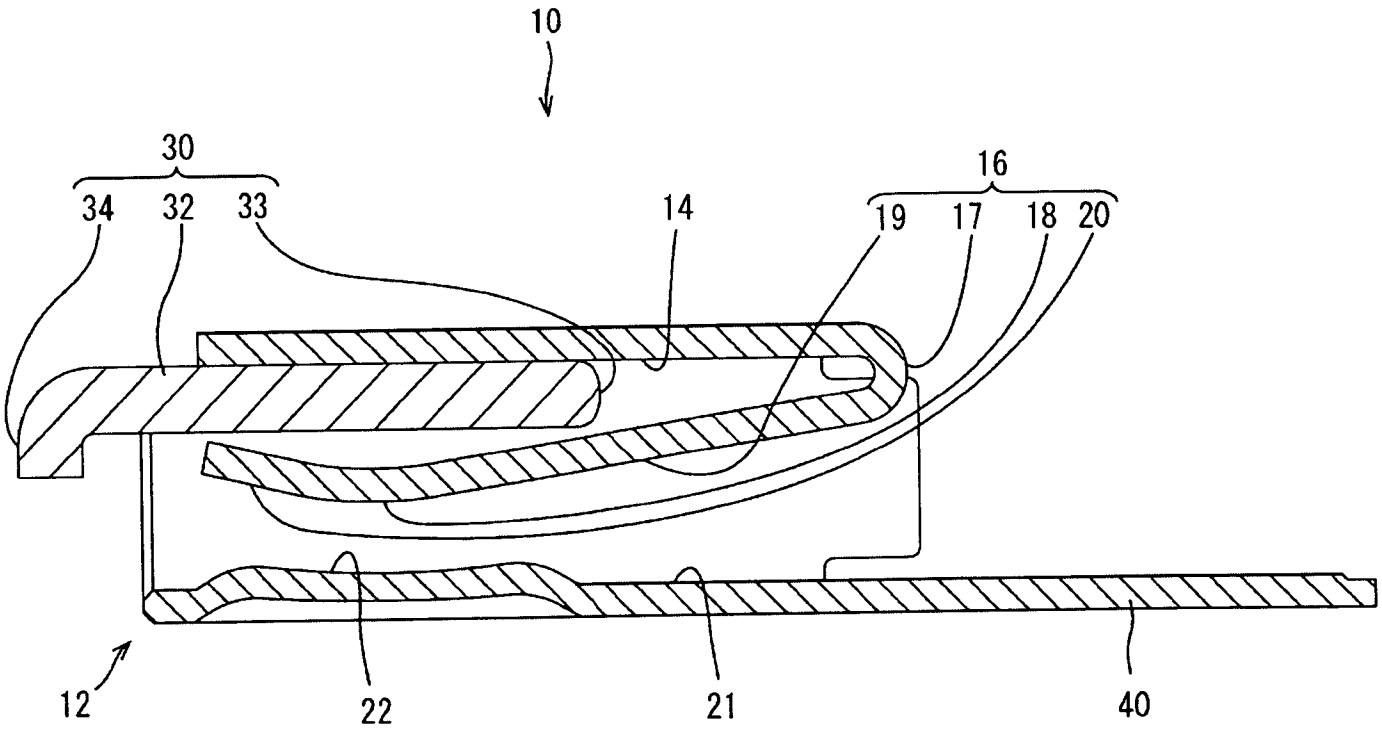
FIG. 3 is a section along A-A of the female terminal in FIG. 1.

A female terminal 10 of this embodiment is formed by stamping and bending a copper plate. Further, plating of silver or the like is applied to the processed female terminal 10. As shown in FIG. 3, the female terminal 10 includes a box-shaped female body portion 12, a pressure increasing plate 30 to be inserted into the female body portion 12 and a wire connecting portion 40 provided behind the female body portion 12. The female terminal 10 is fit to a male terminal 50.

Figure 6:
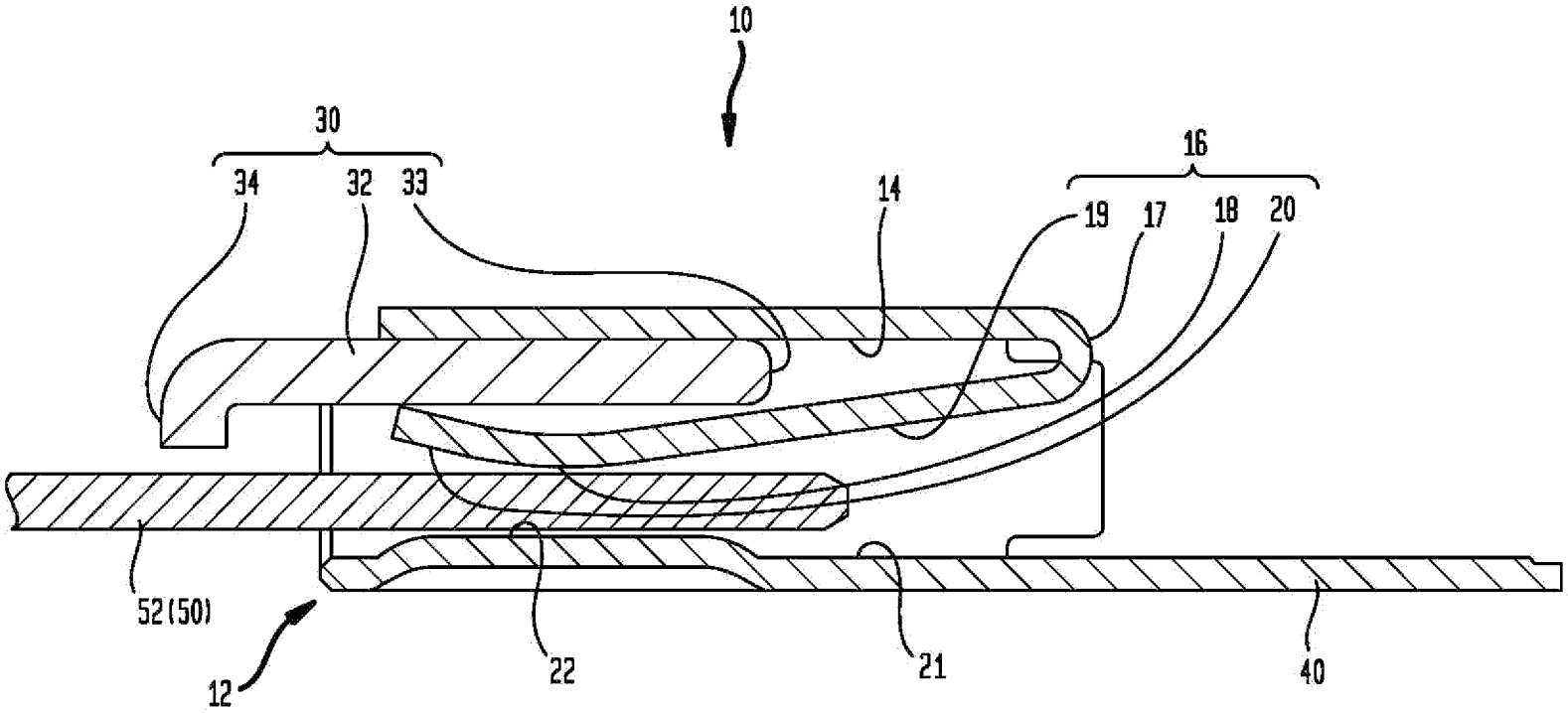
FIG. 6 is a section along B-B of the female terminal before the insertion of the pressure increasing plate in FIG. 4.
Figure 7:
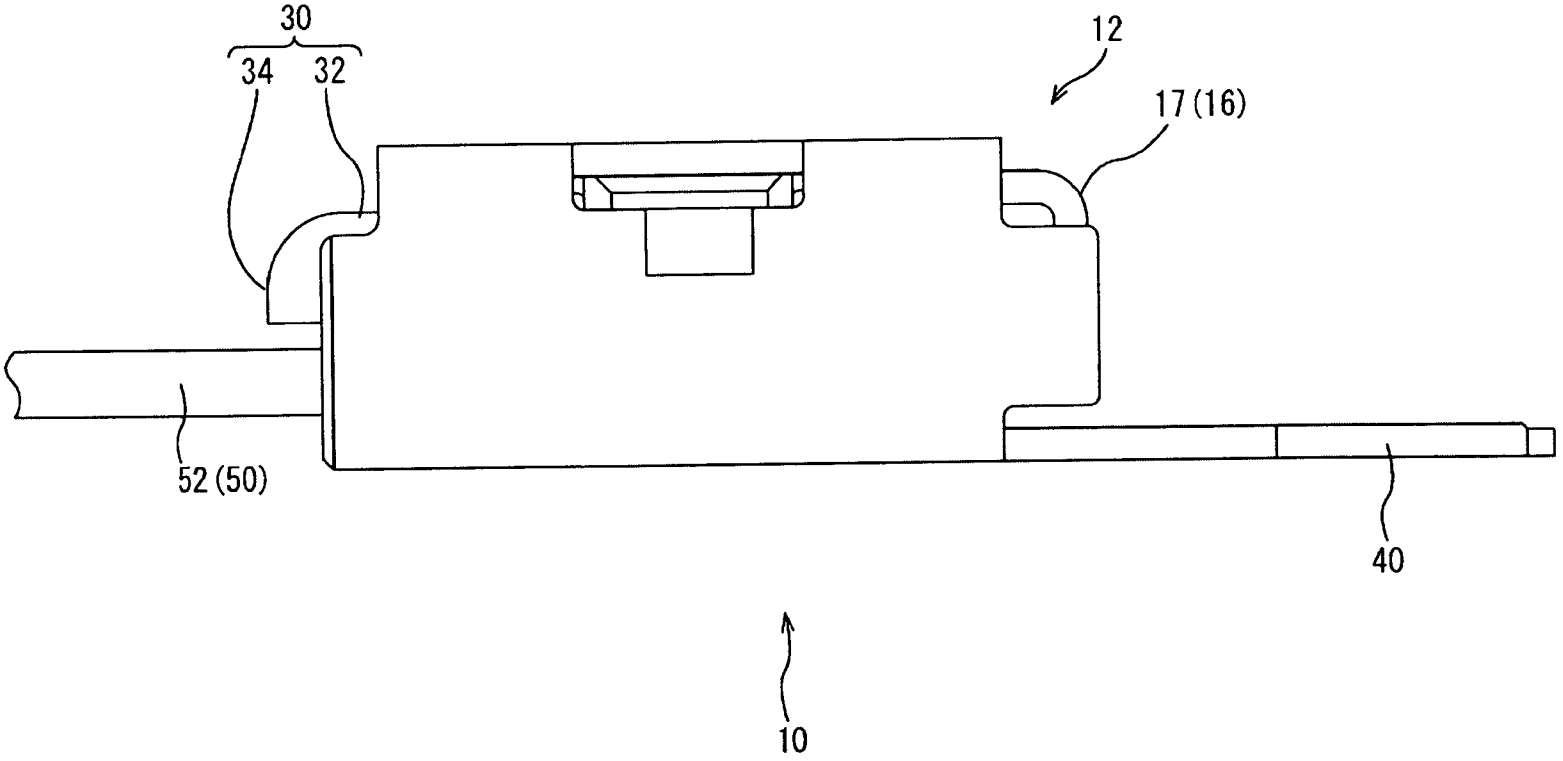
FIG. 7 is a right side view of the female terminal after the insertion of a pressure increasing plate in FIG. 4.

The male terminal 50 is formed by stamping and bending a plate. Further, plating of silver or the like is applied to the processed male terminal 50. As shown in FIG. 6, the male terminal 50 includes a plate-like male body portion 52.

Although not shown, the female terminal 10 and the male terminal 50 are respectively accommodated into a female housing and a male housing. In the following description, a fitting direction of the female terminal 10 to the male terminal 50 is referred to as a forward direction, and a direction from the bottom wall 21 toward a ceiling wall 14 of the female body portion 12 is referred to as an upward direction.

The box-shaped female body portion 12 is open in a front-rear direction. The ceiling wall 14 located on an inner upper side of the female body portion 12 includes contact pressure applying portions 16 for applying a contact pressure to the male body portion 52.

Figure 1:
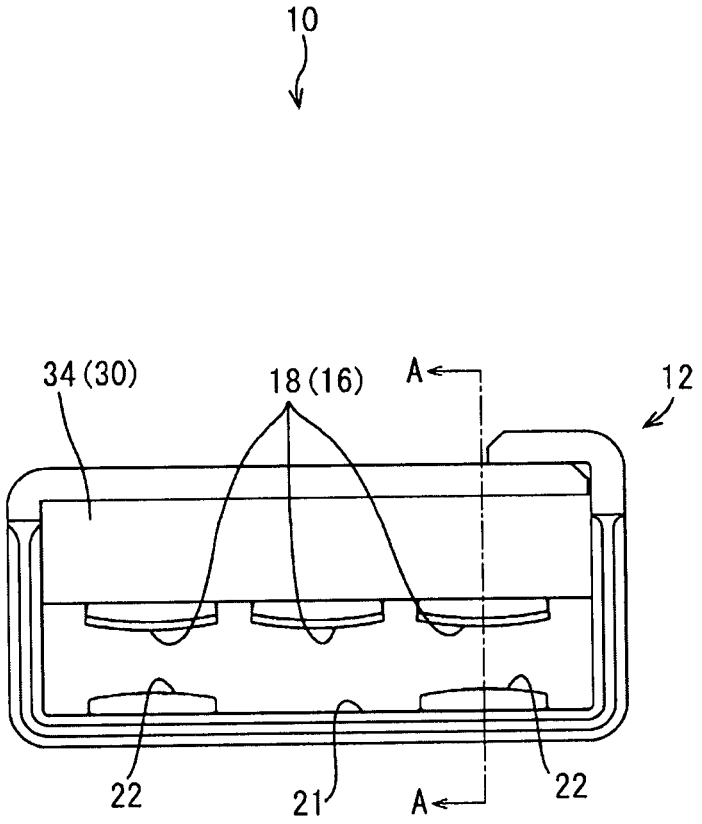
FIG. 1 is a front view of a female terminal in a first embodiment.
Figure 2:
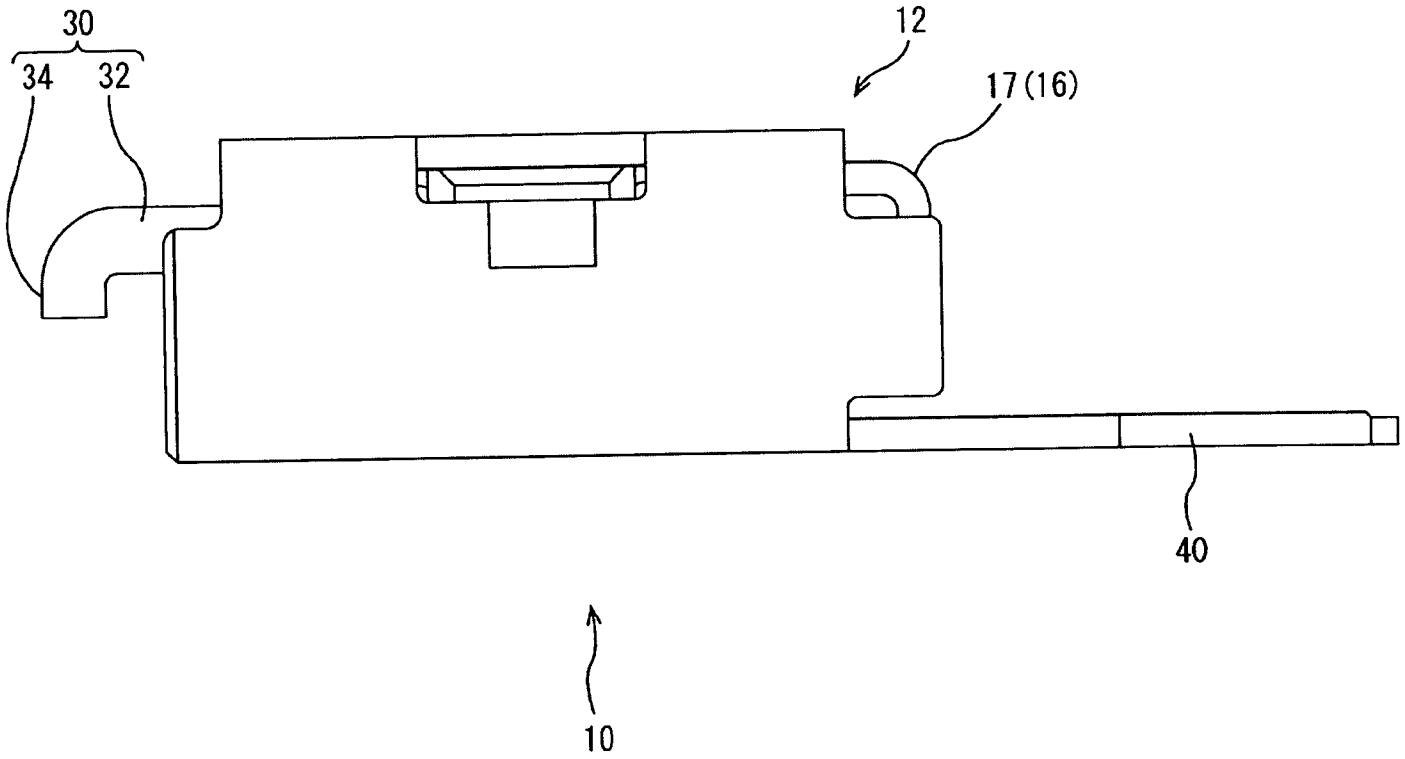
FIG. 2 is a right side view of the female terminal in FIG. 1.

The contact pressure applying portions 16 in this embodiment are three contact pieces provided at equal intervals in a direction intersecting an inserting direction of the male terminal 50 into the female body portion 12, as shown in FIG. 1. As shown in FIG. 3, the contact pressure applying portion 16 is integral with the female body portion 12. The contact pressure applying portion 16 is in the form of a cantilever extending forward from a rear end part of the ceiling wall 14 via a base end part 17 connected to the ceiling wall 14. The contact pressure applying portion 16 includes a contact portion 18 configured to contact the male body portion 52, the base end part 17 connected to the ceiling wall 14, a rear inclined portion 19 connecting the contact portion 18 and the base end part 17 and a front inclined portion 20 inclined up toward the front from the contact portion 18. If the male body portion 52 is inserted into the female body portion 12, the contact portions 18 of the contact pressure applying portions 16 contact the male body portion 52 as shown in FIG. 6. A contact pressure of the contact pressure applying portions 16 is adjusted to such a contact pressure as not to wear the plating applied to the female body portion 12 and the male body portion 52 due to sliding movements of the contact portions 18 and the male body portion 52 in inserting the male body portion 52 into the female body portion 12.

Figure 4:
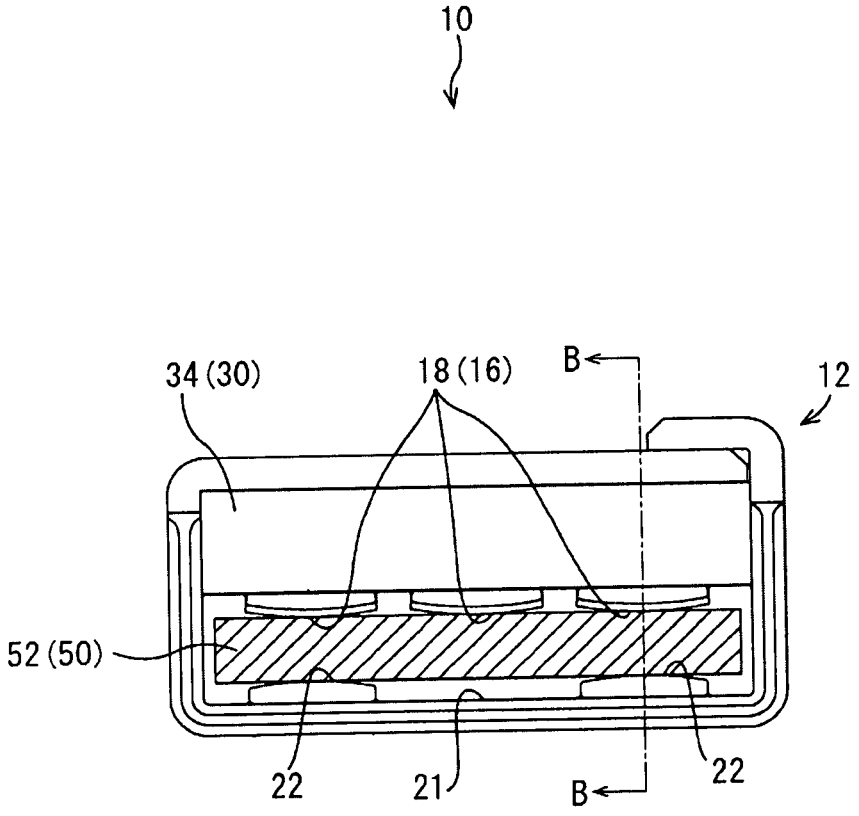
FIG. 4 is a front view of the female terminal in a state fit to a male terminal in the first embodiment.
Figure 5:
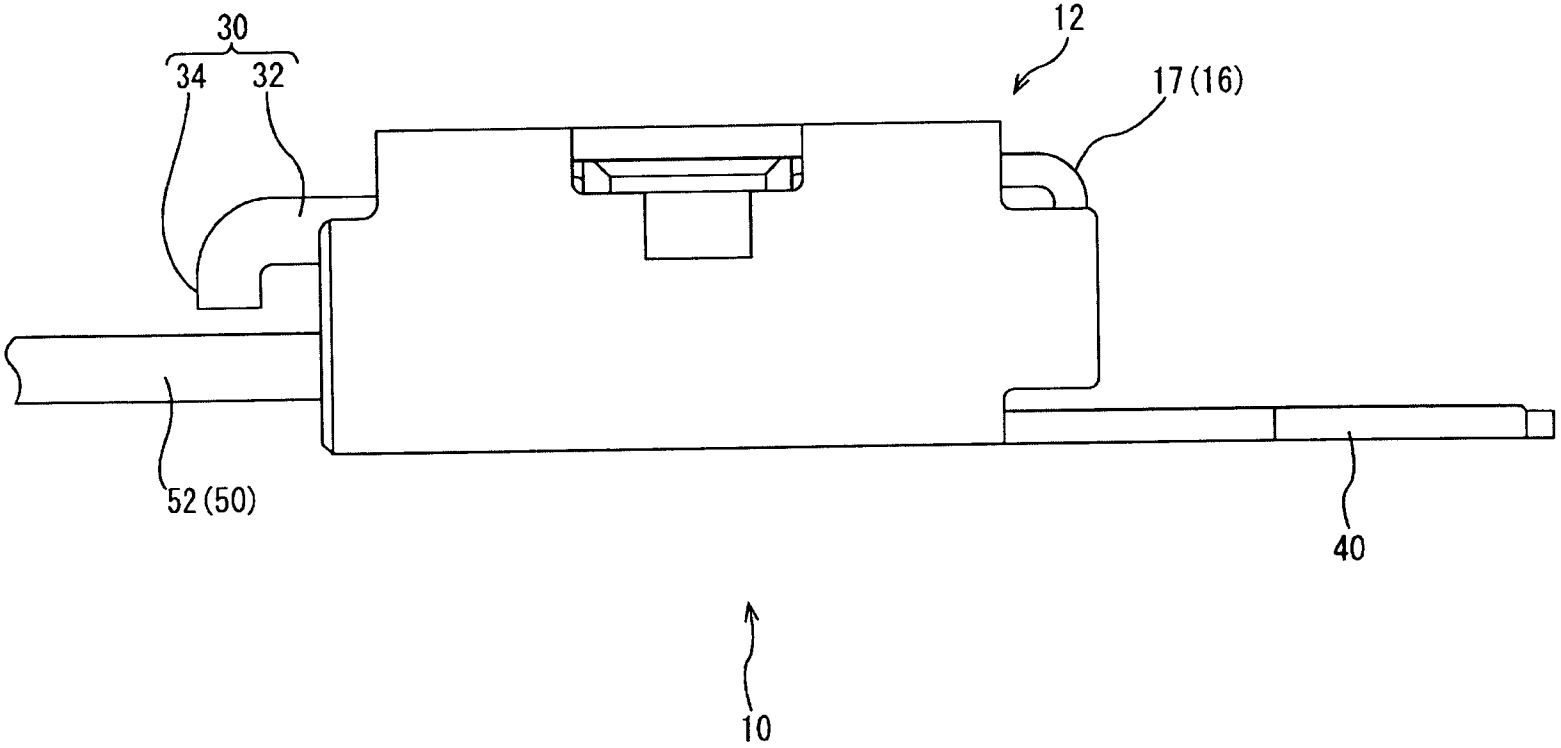
FIG. 5 is a right side view of the female terminal before the insertion of a pressure increasing plate in FIG. 4.

The bottom wall 21 of the female body portion 12 is provided with bottom wall contact portions 22 configured to contact the male body portion 52. The bottom wall contact portions 22 are in the form of beads projecting up from the bottom wall 21 at positions corresponding to the contact portions 18 on both ends, out of the three contact portions 18, as shown in FIG. 1, and contact the male body portion 52 as shown in FIG. 4.

The pressure increasing plate 30 includes a plate-like plate body 32 and a press-contact portion 34, as shown in FIG. 3. The pressure increasing plate 30 is formed by stamping and bending a metal plate and separate from the female body portion 12. The press-contact portion 34 is formed by bending a front end down at a right angle. An end part (end part opposite to the press-contact portion 34) 33 of the plate body portion 32 is rounded. The pressure increasing plate 30 is inserted between the ceiling wall 14 and the contact pressure applying portions 16 inside the female body portion 12. Further, the pressure increasing plate 30 is inserted into the female body portion 12 up to a position where the end part 33 and the rear inclined portion 19 do not contact each other.

The wire connecting portion 40 projects rearward from the rear end of the bottom wall 21. An unillustrated wire is connected to the wire connecting portion 40, and the female terminal 10 and the wire are electrically conductive.

Next, functions of the first embodiment are described.

As shown in FIG. 6, the male body portion 52 of the male terminal 50 is inserted into the female body portion 12 of the female terminal 10 to fit the male terminal 50 and the female terminal 10. At the time of fitting the male terminal 50 and the female terminal 10, the male terminal 50 is inserted into the female body portion 12 while the male body portion 52 of the male terminal 50 is sliding against the contact portions 18 of the contact pressure applying portions 16 and the bottom wall contact portions 22. The contact pressure of the contact pressure applying portions 16 is adjusted to such a contact pressure as not to wear the plating, as described above. Thus, the male body portion 52 can be inserted into the female body portion 12 without wearing the plating applied inside the male body portion 52 and the female body portion 12. Further, terminal insertion workability can be improved by reducing an insertion force in inserting the male terminal 50 into the female body portion 12.

Figure 8:
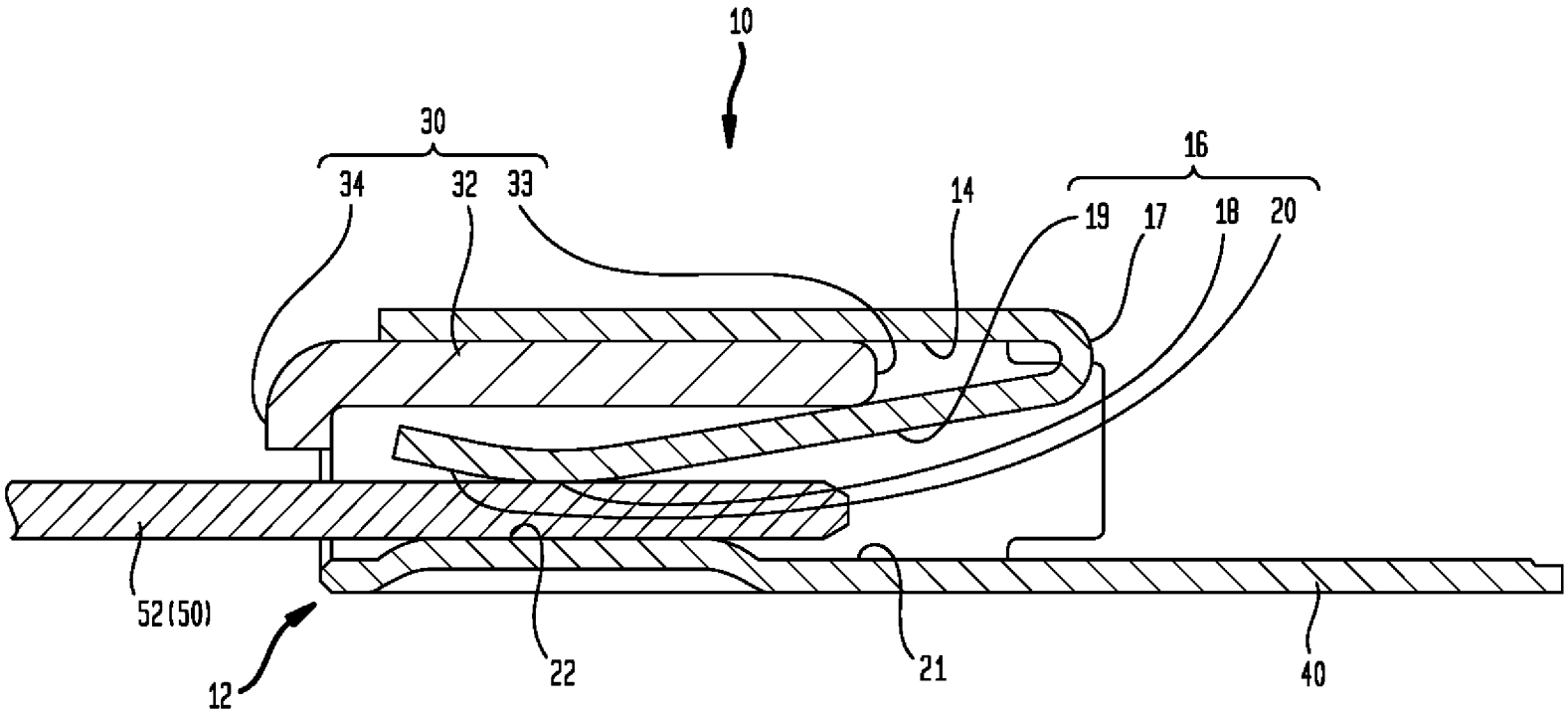
FIG. 8 is a section along B-B of the female terminal after the insertion of the pressure increasing plate in FIG. 4.
Figure 9:
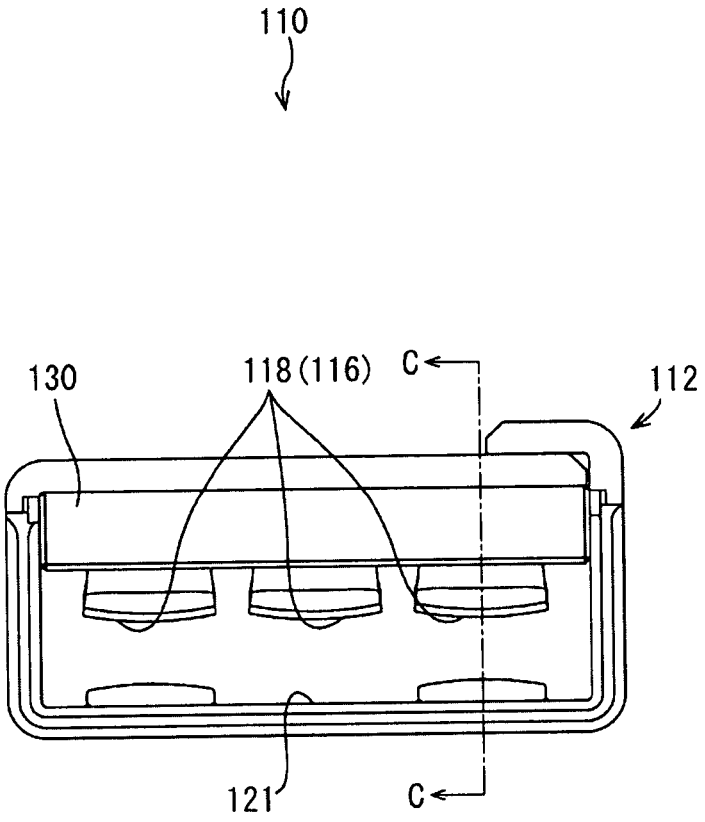
FIG. 9 is a front view of a female terminal in a second embodiment.
Figure 10:
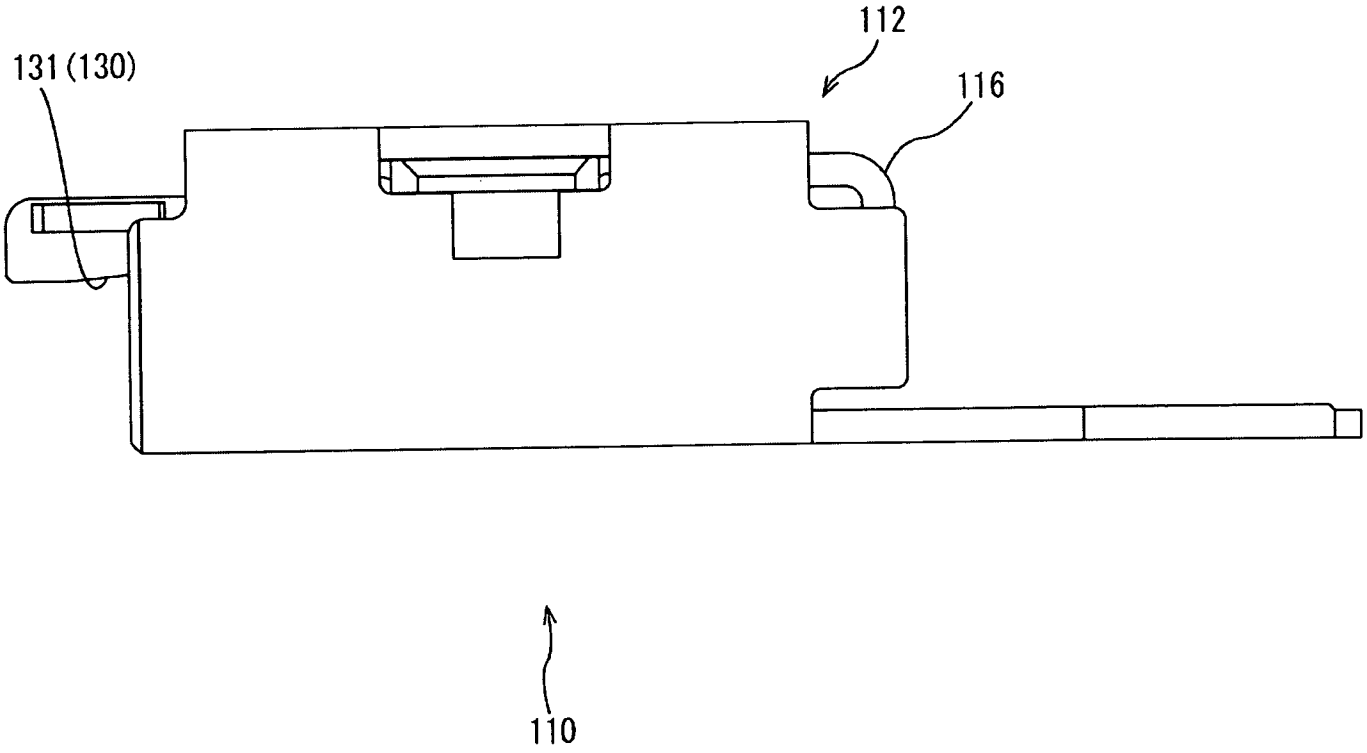
FIG. 10 is a right side view of the female terminal in FIG. 9.

As shown in FIG. 8, after the insertion of the male body portion 52 into the female body portion 12, the press-contact portion 34 of the pressure increasing plate 30 is pushed in the inserting direction of the male body portion 52 to insert the pressure increasing plate 30 into the female body portion 12. During the insertion of the pressure increasing plate 30 into the female body portion 12, the contact pressure applying portions 16 are displaced down while the end part 33 of the plate body portion 32 is sliding against the rear inclined portions 19 of the contact pressure applying portions 16. In this way, the contact pressure applied to the male body portion 52 by the contact pressure applying portions 16 is increased and a high contact pressure is applied to the male body portion 52 of the male terminal 50 by the boosted contact pressure applying portions 16. In this state, the male terminal 50 and the female terminal 10 are energized. If vibration is applied to the male and female terminals 50, 10, the contact portions 18 with the male body portion 52 also swing. However, the high contact pressure is applied to the male body portion 52 by the contact pressure applying portions 16, as described above. Thus, the electrical connection of the female terminal 10 and the male terminal 50 is continued without being broken. In this way, the occurrence of a connection failure between the male terminal 50 and the female terminal 10 due to vibration or the like can be prevented.

The pressure increasing plate 30 is pulled out to separate the male terminal 50 from the inside of the female body portion 12. This causes the contact pressure applying portions 16 to be displaced toward the ceiling wall 14, thereby reducing the contact pressure applied to the male body portion 52 by the contact pressure applying portions 16. If the male terminal 50 is separated from the inside of the female body portion 12 in this state, the male terminal 50 can be separated from the inside of the female body portion 12 without wearing the plating applied to the insides of the male body portion 52 and the female body portion 12.

As described above, the contact pressure applying portions 16 are not displaced toward the bottom wall 21 before the insertion of the pressure increasing plate 30 according to the first embodiment. Thus, the male terminal 50 is inserted into the female body portion 12 in a state where the contact pressure applied to the male terminal 50 by the contact pressure applying portions 16 is low or zero. Thus, the male terminal 50 will not slide against the contact pressure applying portions 16 during the insertion of the male terminal 50 into the female body portion 12, and the plating applied to the male terminal 50 and the female terminal 10 will not wear. Further, terminal insertion workability can be improved by reducing the insertion force in inserting the male terminal 50 into the female body portion 12.

By inserting the pressure increasing plate 30 into the female body portion 12 after the insertion of the male terminal 50 into the female body portion 12, the contact pressure applying portions 16 can be displaced toward the bottom wall 21 to increase the contact pressure applied to the male terminal 50. Thus, the occurrence of a connection failure between the male terminal 50 and the female terminal 10 due to vibration or the like can be prevented.

In the case of separating the male terminal 50 from the inside of the female body portion 12, the contact pressure applied to the male terminal 50 is reduced or eliminated by pulling out the pressure increasing plate 30 from between the ceiling wall 14 of the female body portion 12 and the contact pressure applying portions 16 before the separation of the male terminal 50 is started. Thus, the male terminal 50 will not slide against the contact pressure applying portions 16 at the time of separating the male terminal 50, and the plating applied to the male terminal 50 and the female terminal 10 will not wear.

The pressure increasing plate 30 is inserted from the front. Thus, the pressure increasing plate 30 can be inserted, following an operation of connecting the male housing holding the male terminal 50 to the female housing holding the female terminal 10. Further, since the female body portion 12 and the contact pressure applying portions 16 are integrated, the cost of the female terminal 10 can be reduced.

The end part 33 of the pressure increasing plate 30 comes into contact with the rear inclined portions 19 of the contact pressure applying portions 16 to push down the contact pressure applying portions 16 toward the bottom wall 21 during the insertion of the pressure increasing plate 30 into the female body portion 12. Therefore, the contact portions 18 can be displaced toward the bottom wall 21 to increase the contact pressure applied to the male terminal 50.

Second Embodiment

A second embodiment obtained by changing the shape of the pressure increasing plate 30 of the first embodiment is described with reference to FIGS. 9 to 16.

Figure 11:
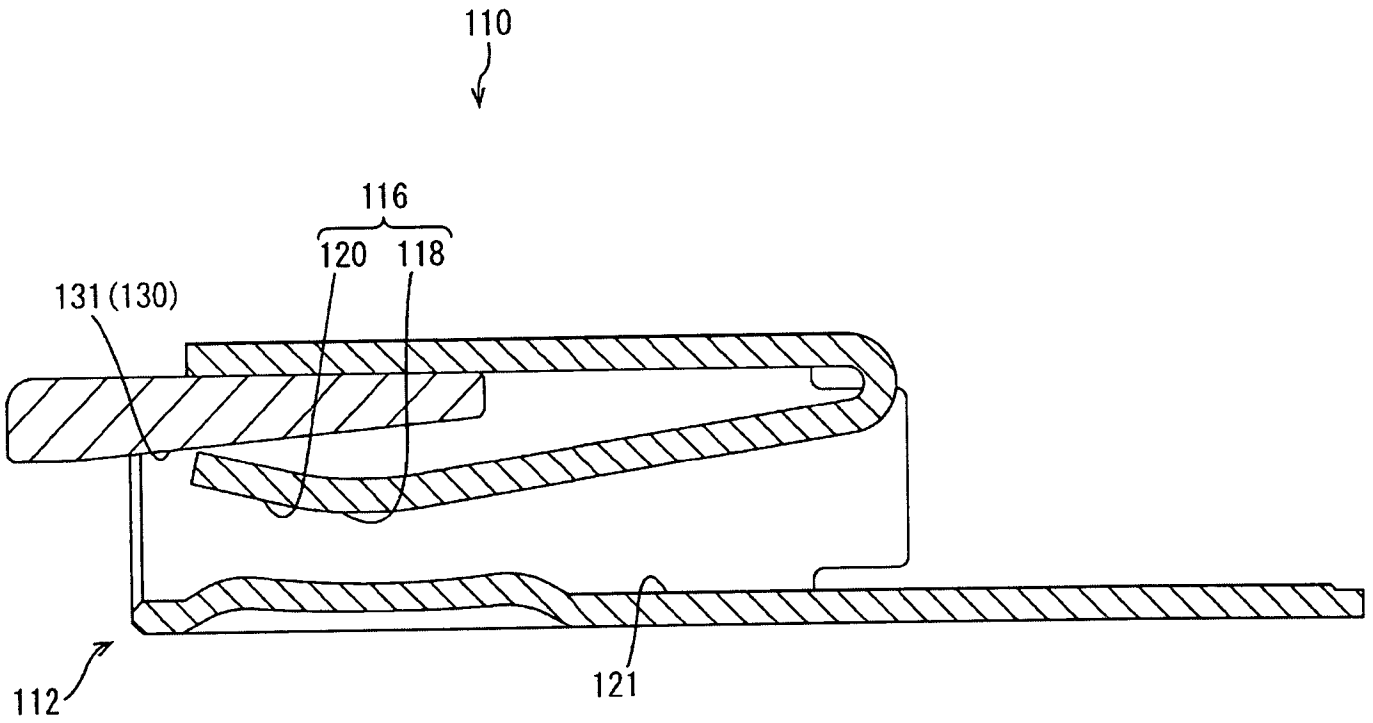
FIG. 11 is a section along C-C of the female terminal in FIG. 9.
Figure 12:
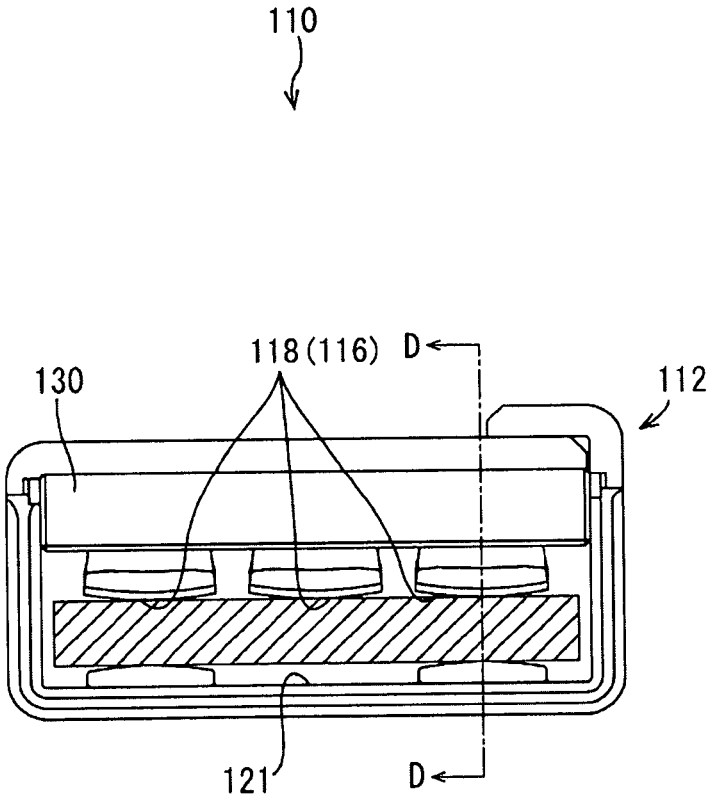
FIG. 12 is a front view of the female terminal in a state fit to a male terminal in the second embodiment.
Figure 13:
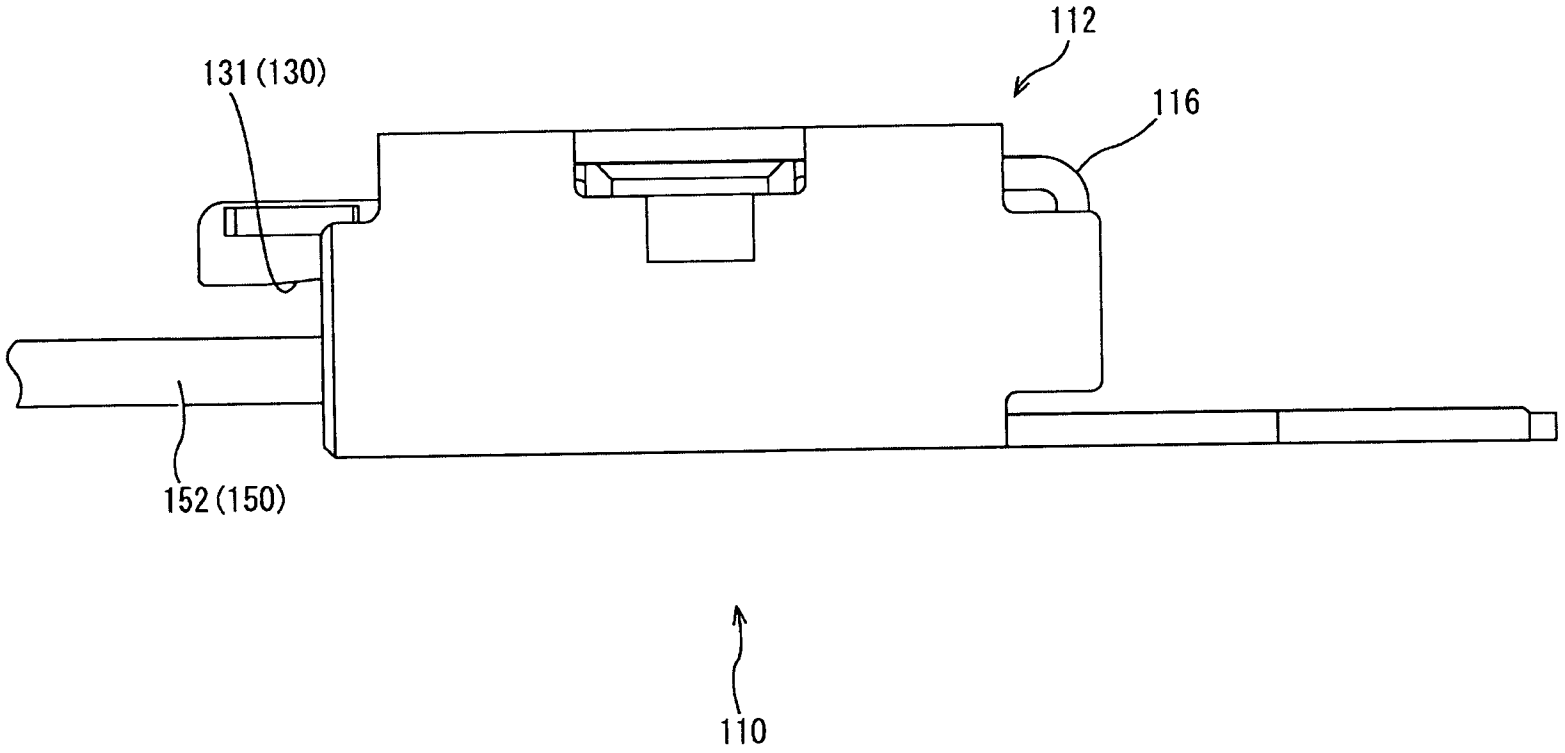
FIG. 13 is a right side view of the female terminal before the insertion of a pressure increasing plate in FIG. 12.
Figure 14:
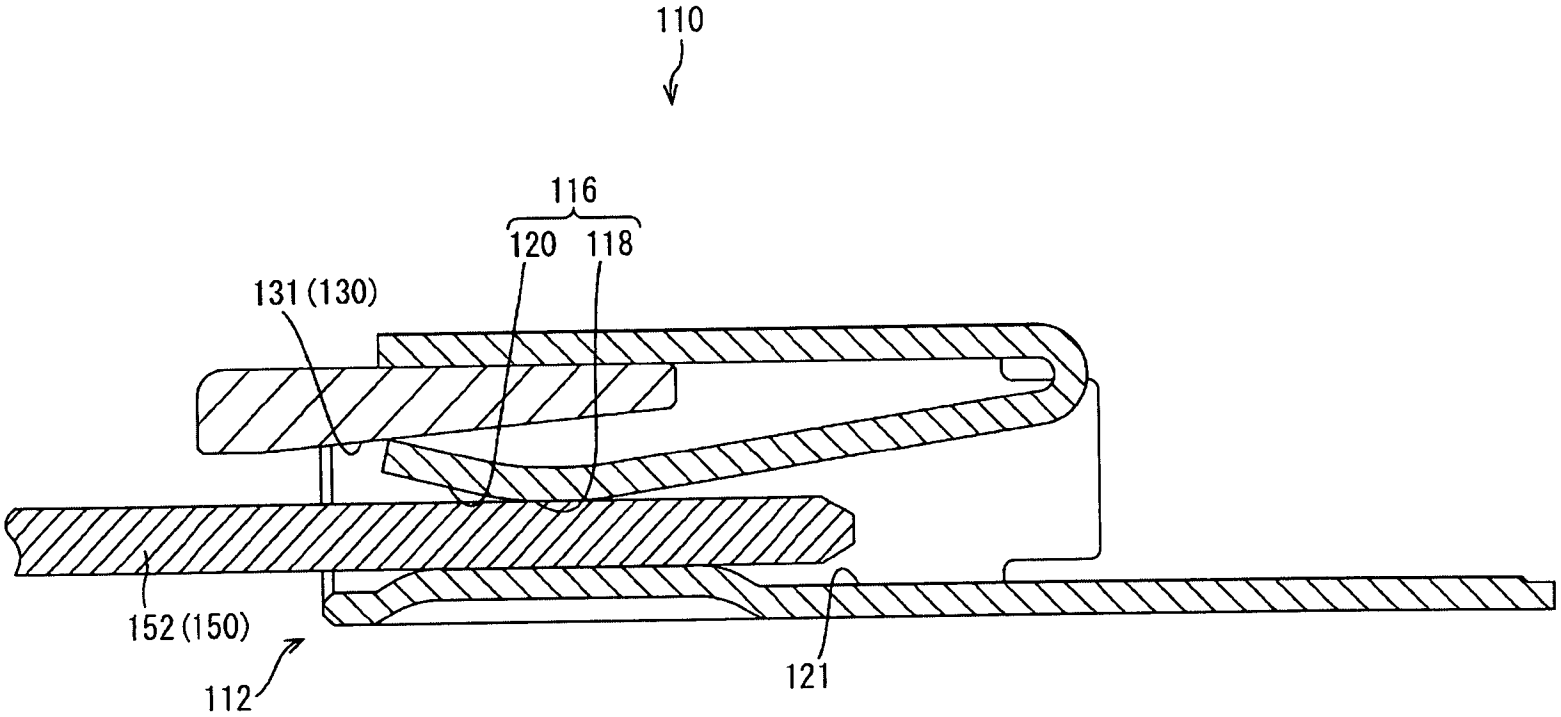
FIG. 14 is a section along D-D of the female terminal before the insertion of the pressure increasing plate in FIG. 12.
Figure 15:
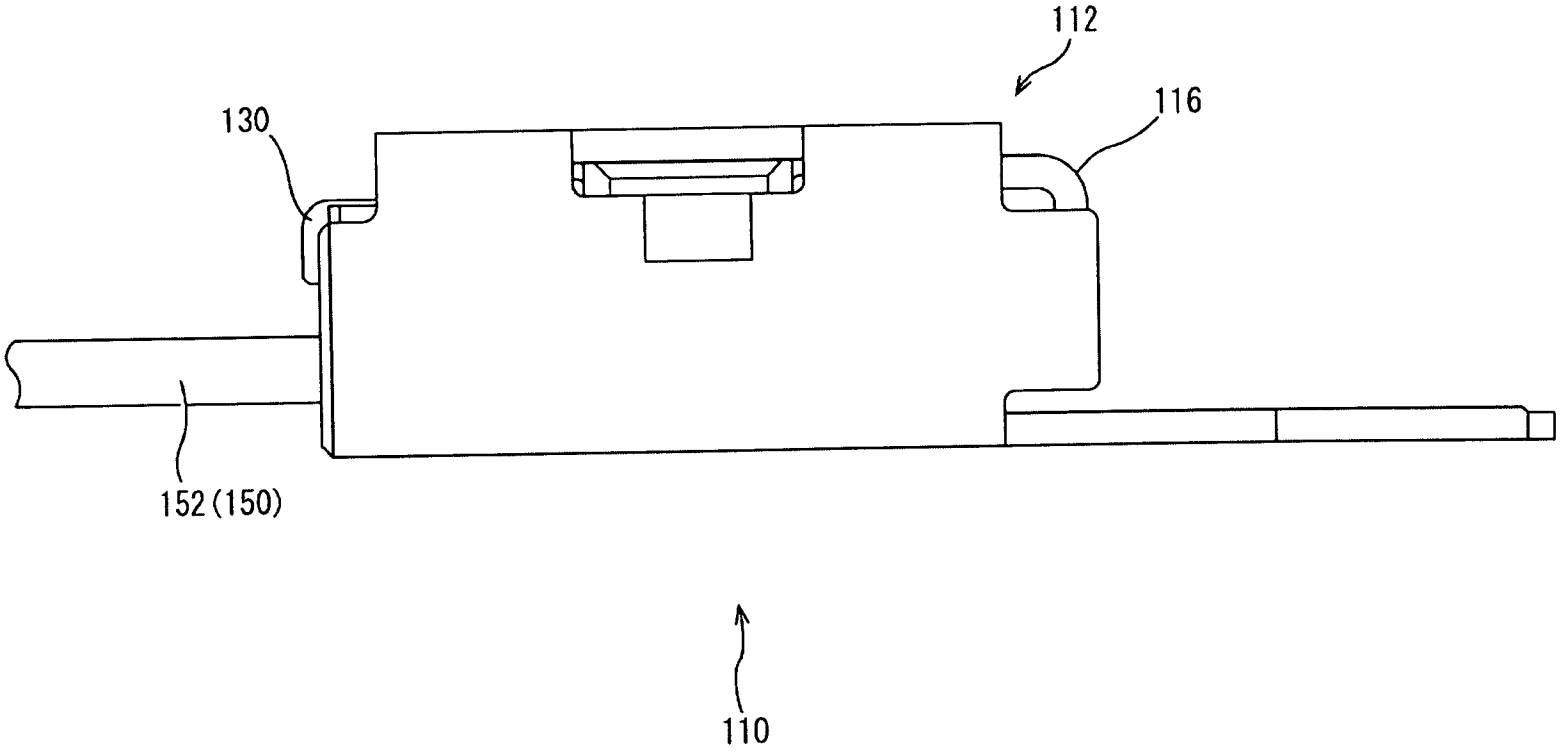
FIG. 15 is a right side view of the female terminal after the insertion of the pressure increasing plate in FIG. 12.

As shown in FIG. 11, a pressure increasing plate 130 of the second embodiment includes a tapered portion 131 tapered toward a tip in an inserting direction. As shown in FIG. 14, the pressure increasing plate 130 is inserted into a female body portion 112 applying portions 116 up to a position where contact pressure applying portions 116 are not displaced toward a bottom wall 121. Other components are not described since being similar to those of the first embodiment.

Next, functions of the second embodiment are described.

Figure 16:
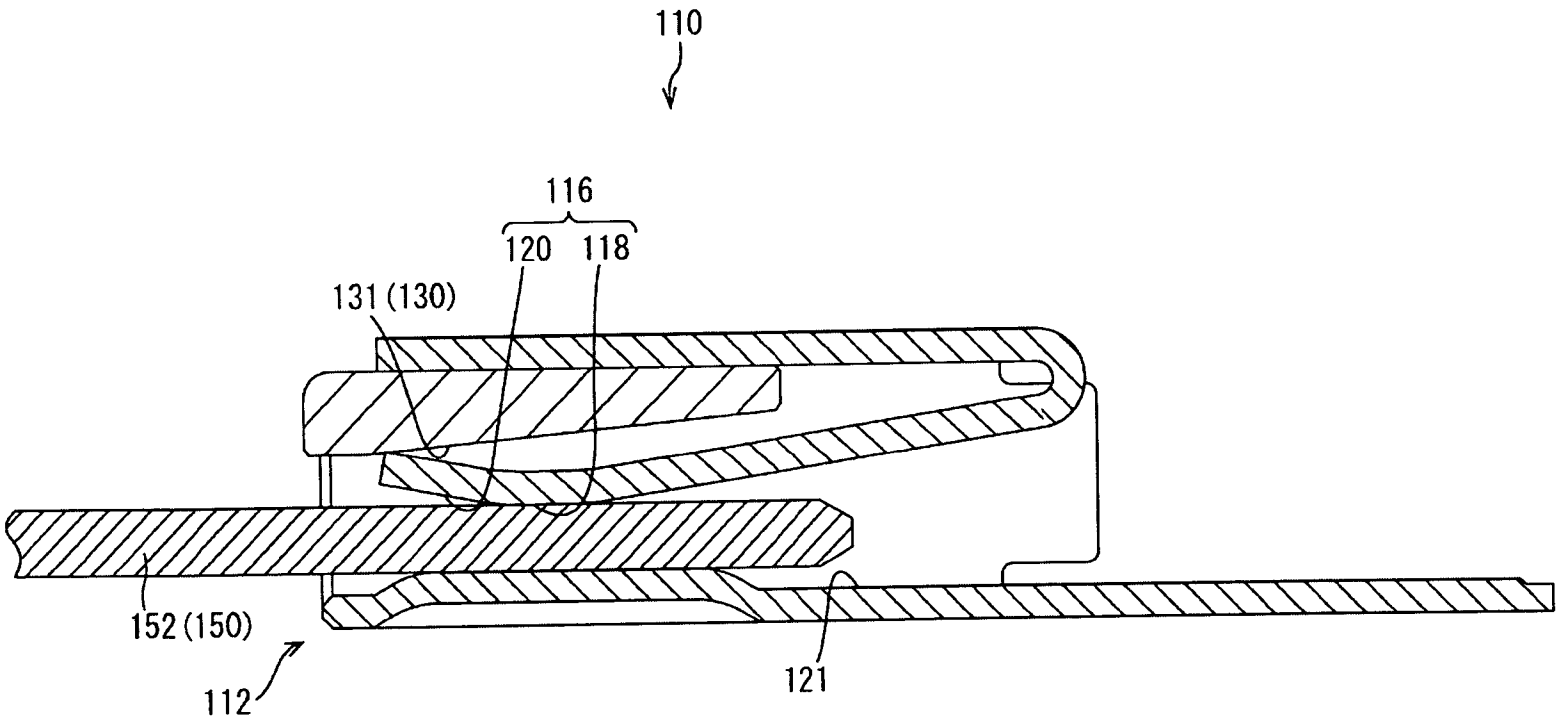
FIG. 16 is a section along D-D of the female terminal after the insertion of the pressure increasing plate in FIG. 12.

As shown in FIG. 14, a male body portion 152 of a male terminal 150 is inserted into the female body portion 112 of a female terminal 110. Subsequently, as shown in FIG. 16, the pressure increasing plate 130 is pushed in the inserting direction of the male body portion 152. At this time, the contact pressure applying portions 116 are displaced toward the bottom wall 121 while the tapered portion 131 of the pressure increasing plate 130 is sliding against tips of front inclined portions 120 of the contact pressure applying portions 116. In this way, a contact pressure applied to the male body portion 152 by contact portions 118 of the contact pressure applying portions 116 is increased.

As described above, according to the second embodiment, the tapered portion 131 of the pressure increasing plate 130 comes into contact with the tips of the front inclined portions 120 of the contact pressure applying portions 116 to push down the contact pressure applying portions 116 toward the bottom wall 121. Thus, the contact portions 118 can be displaced toward the bottom wall 121 to increase the contact pressure applied to the male terminal 150.

The invention is not limited to the above described and illustrated embodiments. For example, the following various modes also are included.

Although the pressure increasing plate 30 has a plate-like shape in the first embodiment, the pressure increasing plate 30 may have any shape as long as the pressure increasing plate 30 can displace the contact pressure applying portions 16 toward the bottom wall 21 by being inserted into between the ceiling wall 14 and the contact pressure applying portions 16. For example, a pressure increasing plate may have a rod-like shape or an end part of the pressure increasing plate may have a spherical shape.

Although the contact pressure applying portions 16 are integral with the female body portion 12 in the first embodiment, the contact pressure applying portions 16 may be separate bodies.

The contact pressure applying portions 16 are in the form of cantilevers extending forward from the rear end part of the ceiling wall 14 of the female body portion 12 in the first embodiment. However, contact pressure applying portions of any form may be used as long as the contact pressure applying portions apply a contact pressure to the male terminal 50 by contacting the male terminal 50 from the side of the ceiling wall 14. For example, the contact pressure applying portions may be in the form of cantilevers extending rearward from a front part of the ceiling wall of the female body portion. Further, the pressure increasing plate may be inserted into the female body portion from behind.

Although the contact pressure of the contact pressure applying portions 16 before the insertion of the pressure increasing plate 30 is such a contact pressure as not to wear the plating of the terminals in the first embodiment, no contact pressure may be applied.

LIST OF REFERENCE SIGNS

10 . . . female terminal
12 . . . female body portion
14 . . . ceiling wall
16 . . . contact pressure applying portion
17 . . . base end part
18 . . . contact portion
19 . . . rear inclined portion
20 . . . front inclined portion
21 . . . bottom wall
22 . . . bottom wall contact portion
30 . . . pressure increasing plate
32 . . . plate body portion
33 . . . end part
34 . . . press-contact portion
40 . . . wire connecting portion
50 . . . male terminal
52 . . . male body portion
110 . . . female terminal
112 . . . female body portion
116 . . . contact pressure applying portion
118 . . . contact portion
120 . . . front inclined portion
121 . . . bottom wall
130 . . . pressure increasing plate
131 . . . tapered portion
150 . . . male terminal
152 . . . male body portion

The invention claimed is:

1. A female terminal to be fit to a male terminal, comprising:

a box-shaped female body portion with opposite front and rear ends and including a ceiling wall and a bottom wall facing each other in a vertical direction and spaced from one another in the vertical direction, the female body portion being open in a front-rear direction;

a contact pressure applying portion cantilevered forward from a rear end of the ceiling wall and disposed in the box-shaped female body portion so as to be spaced from the ceiling wall and the bottom wall; and a pressure increasing plate provided separately from the female body portion and disposed in the female body portion between the ceiling wall and the contact pressure applying portion, the pressure increasing plate being movable in the female body portion between a forward position and rearward position and being dimensioned to move the contact pressure applying portion toward the bottom wall as the pressure increasing plate is moved to the rearward position, wherein:

the male terminal is insertable into the female body portion between the contact pressure applying portion and the bottom wall without contacting the contact pressure applying portion, and the pressure increasing plate urges the contact pressure applying portion into contact with the male terminal as the pressure increasing plate is moved from the forward position to the rearward position in the female body portion.

2. The female terminal of claim 1, wherein:

the contact pressure applying portion is cantilevered forward from a rear end part of the ceiling wall of the female body portion; and the pressure increasing plate is inserted into the female body portion from the front.

3. The female terminal of claim 2, wherein:

a bottom surface of the pressure increasing plate is tapered rearward; and the bottom surface of the pressure increasing plate slides against a tip part of the front inclined portion of the contact pressure applying portion, thereby displacing the contact pressure applying portion toward the bottom wall.

* * * * *